US009912041B1

(12) United States Patent
Channabasappa et al.

(10) Patent No.: US 9,912,041 B1
(45) Date of Patent: Mar. 6, 2018

(54) ANTENNA CARRIERS WITH MAGNETO-DIELECTRIC MATERIAL AND BEAM-SHAPING ELEMENTS FOR ENHANCED PERFORMANCE AND RADIATION SAFETY OF ELECTRONIC DEVICES

(71) Applicant: Amazon Technologies, Inc., Seattle, WA (US)

(72) Inventors: Eswarappa Channabasappa, Sunnyvale, CA (US); Adrian Napoles, Cupertino, CA (US); Chun Kit Lai, Cupertino, CA (US); Daejoung Kim, Sunnyvale, CA (US); Seng Chin Tai, Rocklin, CA (US); Peruvemba Ranganathan Sai Ananthanarayanan, Sunnyvale, CA (US); Anuj Dron, San Jose, CA (US); Namhoon Kim, San Jose, CA (US); Ulf Jan-Ove Mattsson, Saratoga, CA (US); Rohit Sammeta, Mountain View, CA (US)

(73) Assignee: Amazon Technologies, Inc., Seattle, WA (US)

( * ) Notice: Subject to any disclaimer, the term of this patent is extended or adjusted under 35 U.S.C. 154(b) by 589 days.

(21) Appl. No.: 14/535,245

(22) Filed: Nov. 6, 2014

(51) Int. Cl.
*H01Q 1/24* (2006.01)
*H01Q 19/10* (2006.01)

(52) U.S. Cl.
CPC ..... *H01Q 1/243* (2013.01); *H01Q 19/10* (2013.01)

(58) Field of Classification Search
CPC ..... H01Q 1/243; H01Q 1/38
See application file for complete search history.

(56) References Cited

U.S. PATENT DOCUMENTS 8,493,269 B2 7/2013 Jang et al.
2011/0016702 A1* 1/2011 Byun ..... H01Q 1/243 29/600

(Continued)

OTHER PUBLICATIONS

Ikonen, et al.; Magneto-Dielectric Substrates in Antenna Miniaturization: Potential and Limitations; Radio Laboratory/SMARAD, Helsinki University of Technology; Mar. 15, 2006; pp. 1-19; vol. 1; www.arxiv.org.

(Continued)

*Primary Examiner* — Graham Smith
*Assistant Examiner* — Noel Maldonado
(74) *Attorney, Agent, or Firm* — Lowenstein Sandler LLP

(57) ABSTRACT

Antenna carriers with magneto-dielectric material and beam-shaping elements for enhanced performance and radiation safety of electronic devices are described. One electronic device includes a housing, an antenna element disposed on an antenna carrier, and a printed circuit board (PCB) disposed within the housing, the printed circuit board including radio frequency (RF) circuitry. The antenna carrier can be made up of a plastic cap, a ground plane, and a magneto-dielectric substrate with both dielectric and magnetic properties. The plastic cap is disposed at a first side of the housing and the magneto-dielectric substrate is disposed on a top surface of the plastic cap. The antenna element is disposed on a bottom surface of the magneto-dielectric substrate and electrically coupled to the RF circuitry. The antenna element radiates electromagnetic energy in a resonant mode and the magnetic property of the magneto-dielectric material increase efficiency, frequency bandwidth, or both.

19 Claims, 7 Drawing Sheets

(56) References Cited

U.S. PATENT DOCUMENTS

2014/0320365 A1* 10/2014 Hong ..... H01Q 1/38
343/787
2015/0009077 A1* 1/2015 Lee ..... H01Q 1/243
343/702

OTHER PUBLICATIONS

Mosallaei, et al.; Engineered Meta-Substrates for Antenna Miniaturization; University of Michigan; 2004; pp. 191-193; www.ee.bgu.ac.il.
Kim, et al.; Circularly Polarized Microstrip Patch Antenna Using Artificial Magneto-Dielectric Substrate with Grid Structure; Progress in Electromagnetics Research C; 2011; pp. 9-18; vol. 18; www.jpier.org.
Emerson & Curning Microwave Products, Inc. "ECCOSORB® MF Lossy, Magnetically Loaded, Machinable Stock" Revision Oct. 8, 2008, available at www.eccosorb.com, 5 pages.

* cited by examiner

ANTENNA CARRIERS WITH MAGNETO-DIELECTRIC MATERIAL AND BEAM-SHAPING ELEMENTS FOR ENHANCED PERFORMANCE AND RADIATION SAFETY OF ELECTRONIC DEVICES

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

As portable devices shrink in size and thickness, less and less volume is available for antennas for applications such as Global System for Mobile Communications (GSM), Long Term Evolution (LTE), wireless local area network (WLAN) applications such as the Wi-Fi® technology, Personal Area Network (PAN) applications such as the Bluetooth® technology, global positioning system (GPS) applications, etc. Since the volume available for antenna is very restricted, the antennas' performance (frequency bandwidth and efficiency) are severely degraded resulting in dropped calls, problem locating exact location, reduced bandwidth for data transfer, etc. The antenna performance could be improved to some extent by using dynamic antenna tuners but at a considerable cost.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figures 1A, 1B, 1C:
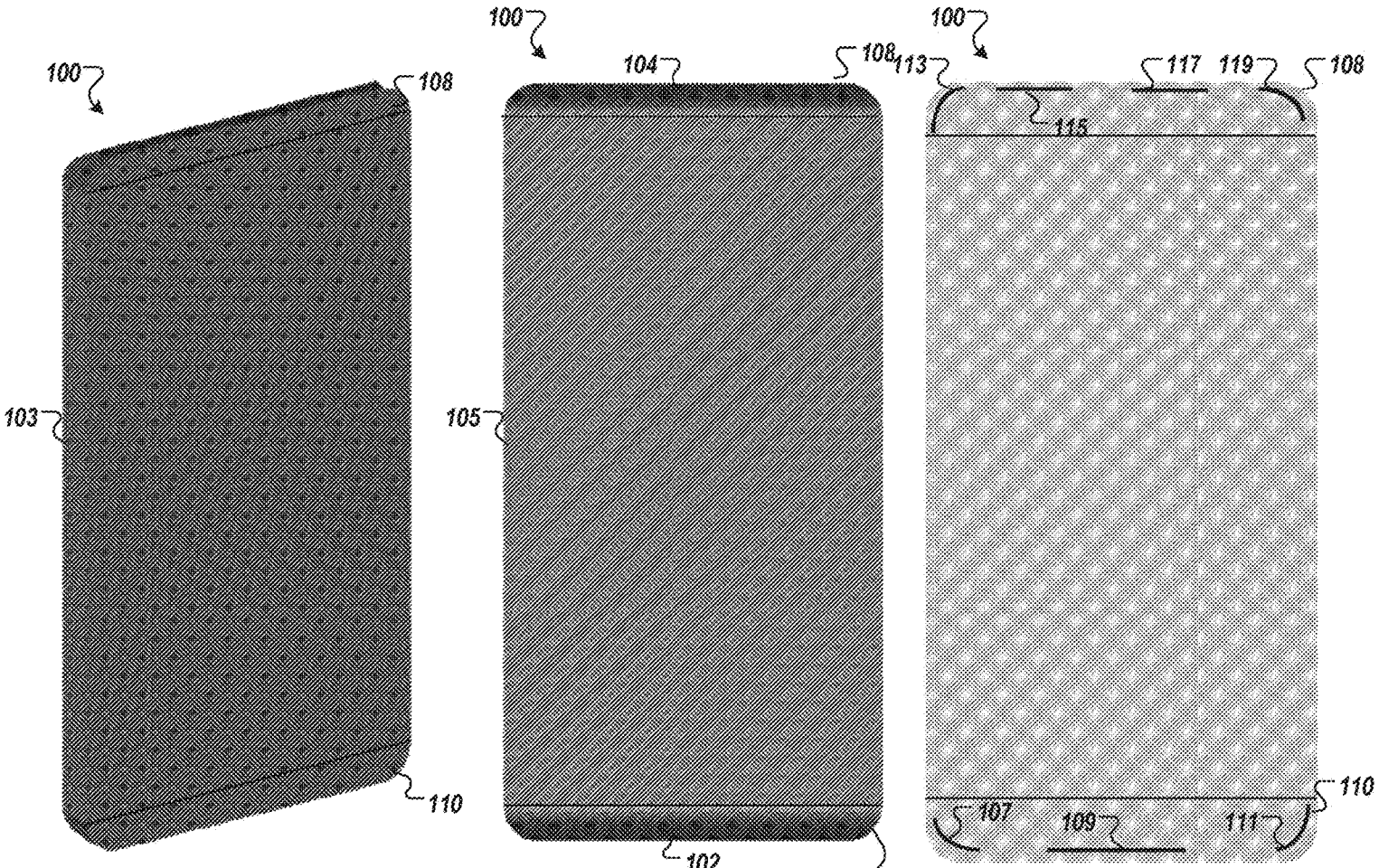
FIGS. 1A-1C are various views of a user device with multiple antennas disposed on antenna carriers with magneto-dielectric material as top and bottom plastic caps of the user device according to various embodiments.

Antenna carriers with magneto-dielectric material and beam-shaping elements for enhanced performance and radiation safety of electronic devices are described. One electronic device includes a housing, an antenna element disposed on an antenna carrier, and a printed circuit board (PCB) disposed within the housing, the printed circuit board including radio frequency (RF) circuitry. The antenna carrier can be made up of a plastic cap, a ground plane, and a magneto-dielectric substrate. The plastic cap is disposed at a first side of the housing. A ground plane, which is electrically coupled to the PCB, is disposed on an internal surface of the plastic cap. The magneto-dielectric substrate is disposed on a top surface of the plastic cap (or embedded in the plastic cap), the first magneto-dielectric substrate having both dielectric and magnetic properties. The magneto-dielectric substrate typically has a relative permittivity value in a range between two and nine for the dielectric property and a relative permeability value is greater than one for the magnetic property. It should be noted that high values of relative permittivity and permeability could be used for miniaturization purposes. That is the relative permittivity value can be even greater than nine. The antenna element is disposed on a top surface of the magneto-dielectric substrate and electrically coupled to the RF circuitry. The antenna element radiates electromagnetic energy in a resonant mode. The higher relative permeability value increases a first wave impedance of the antenna element to increase efficiency, frequency bandwidth of the antenna element, or both. The first wave impedance is a ratio of the relative permeability value to the relative permittivity value. Surface currents generated due to RF signals applied at a feeding point create an electromagnetic field to radiate electromagnetic energy to communicate information. The antenna can be used for Long Term Evolution (LTE) frequency bands, third generation (3G) frequency bands, Wi-Fi® and Bluetooth® frequency bands or other wireless local area network (WLAN) or Personal Area Network (PAN) frequency bands, wide area network (WAN) frequency bands, global positioning system (GPS) frequency bands, or the like. Also, more than one antenna may be disposed on the antenna carriers with magneto-dielectric material as described herein.

In other embodiments described herein, a set of beam-shaping elements may be used to reflect incident electromagnetic fields of the electromagnetic energy away from the first set of beam-shaping elements in a direction towards the antenna element. The beam-shaping elements are metal elements of geometric shapes printed or disposed on magnetic-dielectric substrates that form a high-impedance surface with a reflection coefficient magnitude of one or near one and phase of zero or near zero degrees. For example, the beam-shaping elements may be magnetic material inserts in plastic material to form a magneto-dielectric substrate and metal elements disposed on or within the plastic material. The high-impedance surface may also be referred to as a perfect magnetic surface when the reflection coefficient magnitude is equal to one and phase is zero degrees. The high-impedance surface reflects incident electromagnetic fields of the electromagnetic energy away from the metal elements in a direction towards the antenna element. The reflection coefficient magnitude of the high-impedance surface does not have to be exactly one in magnitude or exactly zero degrees in phase. Rather, the idea is to reflect at least a portion of the electromagnetic energy away from a user's head to keep SAR low. Achieving these ideal reflections usually requires thicker magneto-dielectric substrates. As the space is limited in user devices, thinner substrates with magneto-dielectric material can be used can provide enough high impedance surface to overcome the deleterious effects of human tissues on the antenna efficiencies and also keep SAR low.

In some cases, these beam-shaping elements may be groups of metallic patches disposed on a magneto-dielectric substrate. The set of beam-shaping elements can be disposed in a layer closer to a bottom surface of the magneto-dielectric substrate than a top surface of the magneto-dielectric. The beam-shaping elements reflect incident electromagnetic fields away from the bottom surface to the top surface. In some cases, these beam-shaping elements may be used to direct a radiation pattern away from one side of the user device to reduce SAR. In another embodiment, the magneto-dielectric material is made up of a magneto-dielectric substrate layer and a plastic layer disposed on the magneto-dielectric substrate layer. In a further embodiment, multiple metallic patches are disposed on the substrate magneto-dielectric substrate layer and the antenna element is disposed on the plastic layer. In another embodiment, a metal layer is disposed on a first surface of the magneto-dielectric substrate layer and the plastic layer is disposed on a second surface of the magneto-dielectric substrate layer.

SAR is dependent on the average power transmitted. Power throttling can be used to back off the average power transmitted to ensure that the device complies with FCC regulations concerning radiation absorbed by human tissue, also referred to as SAR requirements. A procedure known as SAR testing quantifies this absorbed radiation. A SAR number is obtained while testing the device in close proximity to a phantom (e.g., gel) that simulates the RF properties of human tissue while it is transmitting at full power. To comply with FCC regulations, some devices use proximity sensors to sense a proximity to tissue and reduce the power accordingly. The embodiments described herein utilize the magneto-dielectric material, beam-shaping elements, or both to reduce SAR when the user device is in proximity to a person (e.g., a human body part) or a SAR phantom (hereinafter "phantom") as used during testing of SAR for the user device to comply with FCC regulation. For example, the embodiments described herein can minimize SAR by reflecting away from one side of the user device electromagnetic fields of electromagnetic energy radiated in response to the surface currents created on the antenna element. This reduces the amount of radiation within any cubic volume on the one side of the user device.

The electronic device (also referred to herein as user device) may be any content rendering device that includes a transceiver for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks. Although the embodiments described herein are directed to portable electronic devices, in other embodiments the magneto-dielectric material and beam-shaping elements may be used in other non-portable electronic devices.

FIGS. 1A-1C are various views of a user device 100 with multiple antennas disposed on antenna carriers 102, 104 with magneto-dielectric material as top and bottom plastic caps of the user device 100 according to various embodiments. The user device 100 includes a front cover 103, as illustrated in the perspective view of FIG. 1A, and a metal back 105, as illustrated in the rear view of FIG. 1B. As illustrated in the front view of FIG. 1C, multiple antennas 107-119 are disposed at various locations on the antenna carriers 102, 104. In one embodiment, antenna 107 is a first Wireless Area Network (WAN) antenna, antenna 109 is a second WAN antenna, and antenna 111 is a third WAN antenna. The antennas 107, 109, 111 are disposed on the antenna carrier 104 as the bottom plastic cap 110. The antenna 113 is a wireless local area network (WLAN) antenna, such as used for the Wi-Fi® technology. Antenna 115 is a global positioning system (GPS) antenna, antenna 117 is a first diversity antenna and antenna 119 is a second diversity antenna. The antennas 115, 117, 119 are disposed on the antenna carrier 102 as the top plastic cap 108. In other embodiments, one or more other types of antennas may be disposed on one or more antenna carriers.

The antenna carrier 102 is disposed at a first side (e.g., bottom side) of a housing structure having the front surface 103 and metal back 105. The antenna carrier 102 includes magneto-dielectric material with both dielectric and magnetic properties. The magneto-dielectric material has relative permittivity in a range between two and nine for the dielectric property and relative permeability greater than one for the magnetic property. An antenna element, such as conductive material of any one of the antennas 107-111, is disposed on a first surface (e.g., top surface) of the antenna carrier 102. The antenna element is configured to radiate electromagnetic energy. The magnetic property of the antenna carrier increases a performance metric of the antenna element. For example, the magnetic property may improve efficiency of the antenna element. For another example, the magnetic property may increase frequency bandwidth of the antenna element. In some cases, the magnetic property increases both efficiency and frequency bandwidth. The higher relative permeability value increases a wave impedance of the antenna element to increase the efficiency, frequency bandwidth, or both. The wave impedance is a ratio of the relative permeability value to the relative permittivity value.

The antenna carrier 104 is disposed at a second side (e.g., top side) of the housing structure. The antenna carrier 104 includes the magneto-dielectric material described above with respect to antenna carrier 102. A second antenna element, such as conductive material of any one of the antennas 113-119, is disposed on a first surface (e.g., top surface) of the antenna carrier 104. The second antenna element is configured to radiate electromagnetic energy in another frequency band (e.g., same or different frequency band than the frequency band of the antenna element disposed on the antenna carrier 102). The magnetic property of the antenna carrier 104 increases a performance metric of the second antenna element. For example, the magnetic property may improve efficiency of the second antenna element. For another example, the magnetic property may increase frequency bandwidth of the second antenna element. In some cases, the magnetic property increase both efficiency and frequency bandwidth. The relative permeability value increases a wave impedance of the second antenna element to increase the efficiency, frequency bandwidth, or both. The wave impedance is a ratio of the relative permeability value to the relative permittivity value.

Figure 2A:
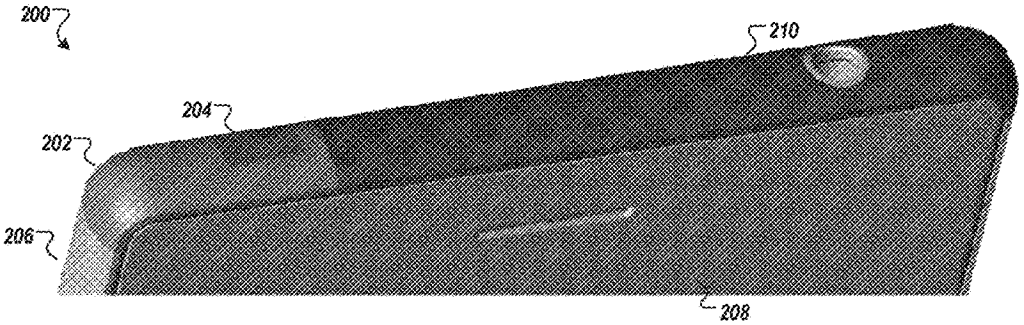
FIG. 2A is a perspective view of a top side of a user device with a structure having an antenna element disposed on an antenna carrier with magneto-dielectric material according to one embodiment.

FIG. 2A is a perspective view of a top side of a user device 200 with a structure having an antenna element 204 disposed on an antenna carrier 202 with magneto-dielectric material according to one embodiment. The user device 200 includes a housing structure 206 with a front surface 208 and a back surface 210. The housing structure 206 may be a metal housing structure. The front surface 208 may be made up of a glass overlay of a display device and the back surface 210 may be a metal back of the user device 200. The structure can include a plastic cap. The plastic cap can be disposed at a top side of the housing structure 206 and can include a portion in which magneto-dielectric material of the antenna carrier 202 is disposed. The top surface of the antenna carrier 202 may be flush with a top surface of the plastic cap. The antenna carrier 202 may be considered a corner cap of the user device 200. Although in the depicted embodiment the antenna carrier 202 and plastic cap are illustrated as two separate parts, in other embodiments, the plastic material of the plastic cap and the magneto-dielectric material of the antenna carrier 202 are integrated into a single composite part.

The structure also includes an antenna element 204 and a ground plane 212. The antenna element 204 is disposed on a top surface of the antenna carrier 202. The antenna element 204 is conductive material, such as a conductive trace, disposed on the magneto-dielectric material of the antenna carrier 202. The antenna element 204 is disposed above a ground plane 212 as illustrated and described with respect to FIG. 2B.

Figure 2B:
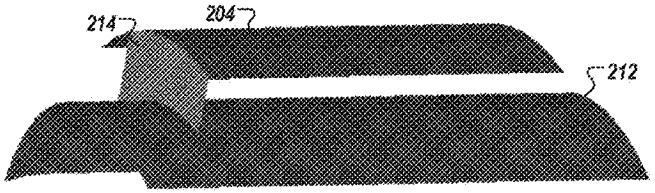
FIG. 2B is a perspective view of a top side of the structure of FIG. 2A according to one embodiment.

FIG. 2B is a perspective view of a top side of the structure of FIG. 2A according to one embodiment. The antenna element 204 is disposed on the top surface of the antenna carrier 202 and the ground plane 212 is disposed on a bottom surface of the antenna carrier 202. The antenna element 204 is grounded to the ground plane 212 at one end of the antenna element 204 using vias 214 through the magneto-dielectric material of the antenna carrier 202 (not illustrated in FIG. 2B).

In one embodiment, the structure forms a patch antenna with a copper patch (e.g., antenna element 204) placed on a top surface of the magneto-dielectric corner cap and a copper ground (e.g., ground plane 212) placed on a bottom surface of the magneto-dielectric corner cap. In a further embodiment, the material properties of the magneto-dielectric material used are relative permittivity of three, relative permeability of three, dielectric loss tangent of 0.004, and magnetic loss tangent of 0.004. As described with respect to FIG. 3 for comparison purposes, a similar antenna with equivalent dielectric-only material has been analyzed. The equivalent dielectric-only materials has relative permittivity of 9 and dielectric loss tangent of 0.004.

Figure 3:
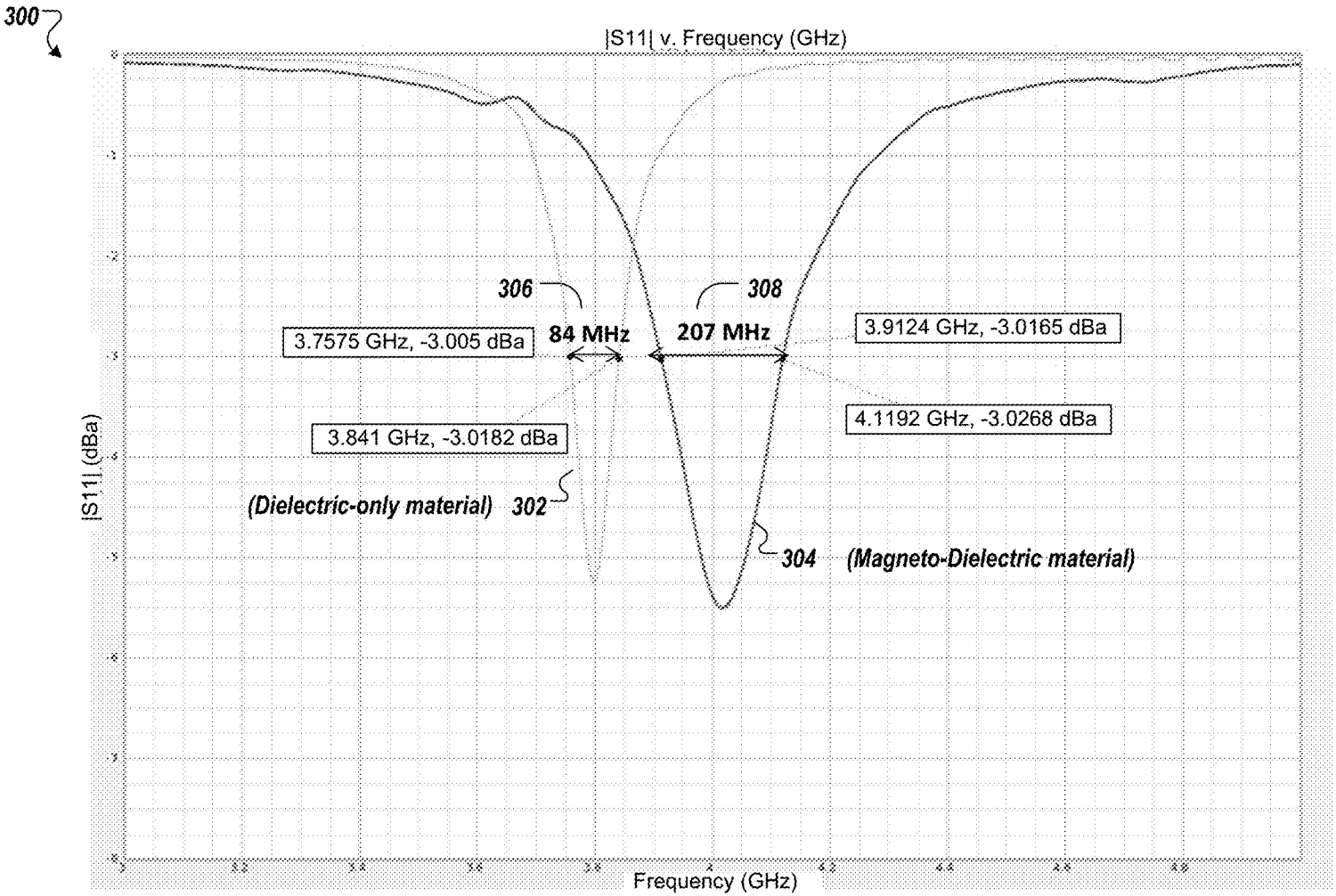
FIG. 3 is a graph of return loss of an antenna structure with dielectric-only material and return loss of the antenna structure with magneto-dielectric material according to one embodiment.

FIG. 3 is a graph 300 of return loss 302 of an antenna structure with dielectric-only material and return loss 304 of the antenna structure with magneto-dielectric material according to one embodiment. The graph 300 shows the return loss 302 (which can also be represented as the S-parameter or measured reflection coefficient or |S11|) of an antenna structure with dielectric-only material (not illustrated) and return loss 304 of the antenna structure of FIGS. 2A, 2B (or antenna structures of any of antennas 107-119 of user device 100 of FIG. 1) with magneto-dielectric material. The computed input return losses 302, 304 of the antenna structures are plotted. As seen in FIG. 3, the antenna structure with magneto-dielectric material gives about 207 MHz 3-dB bandwidth 308, while the antenna structure with equivalent dielectric-only material gives only 84 MHz 3-dB bandwidth 306. The bandwidth improvement obtained with magneto-dielectric material is about 2.5 times in the same antenna volume.

In this depicted embodiment, frequency bandwidth 308 is measured between approximately 3.9124 GHz and approximately 4.1192 GHz at 3-dB and frequency bandwidth 306 is measured between approximately 2.7575 and approximately 3.841 GHz at 3-dB. In other embodiments, the frequency bandwidths can be at other frequencies than about 4 GHz. Also, the depicted embodiment illustrates a single resonant mode. In other embodiments, the antenna structure may be multi-mode antenna structures that provide multiple resonant modes. The magneto-dielectric material of the antenna carrier may increase frequency bandwidth of the multi-mode antenna structures.

In one embodiment, an electronic device includes a transceiver to transmit or receive RF signals, a RF feed coupled to the transceiver, and an antenna coupled to the RF feed. The antenna includes an antenna element and a ground plane disposed in connection with an antenna carrier with magneto-dielectric material, beam-shaping elements, or both. Surface currents at the RF feed and on the antenna elements create electromagnetic fields. In some cases, incident electromagnetic fields are reflected by the beam-shaping elements in a direction away from the beam-shaping elements.

In one embodiment, the antenna structure with magneto-dielectric material can be configured for the LTE 700 (band 17), 1800 (band 3), 2600 (band 7), etc., UMTS, GSM (850, 800, 1800 and 1900), GPS, Wi-Fi® and Bluetooth® frequency bands, or the like. In another embodiment, the antenna structure with magneto-dielectric material can be designed to operate in any of the bands described herein. For example, the antenna structure with magneto-dielectric material can be used in the following bands: 1) LTE band: 746 to 787 MHz; 2) US GSM 850: 824 to 894 MHz; 3) GSM900: 880 to 960 MHz; 4) GSM 1800/DCS: 1.71 to 1.88 GHz; 5) US1900/PCS (band 2): 1.85 to 1.99 GHz; and 6) WCDMA band I (band 1): 1.92 to 2.17 GHz. Alternatively, the antenna structure with magneto-dielectric material can be designed to operate in different combinations of frequency bands as would be appreciated by one of ordinary skill in the art having the benefit of this disclosure. Alternatively, the antenna structure with magneto-dielectric material can be configured to be tuned to other frequency bands as would be appreciated by one of ordinary skill in the art having the benefit of this disclosure. For example, the antenna structure with magneto-dielectric material can be tuned to be centered at various frequencies, such as, at approximately 2.44 GHz for a first frequency range at approximately at 5.5 GHz for a second frequency range of the dual band. The first and second frequency ranges can be tuned to be centered at other frequencies.

In other embodiments, the magneto-dielectric material may increase an efficiency of the antenna structure. The total efficiency of the antenna structure can be measured by measuring the loss of the structure (e.g., due to mismatch loss), dielectric loss, and radiation loss. The efficiency of the antenna can be tuned for specified target bands. The efficiency of the antenna structure may be modified by adjusting the magnetic property of the magneto-dielectric material (e.g., permeability). In addition, dimensions of the antenna structure (2D or 3D structure), the gaps between the elements of the antenna structure, or any combination thereof, may also be used to tune the efficiency of the antenna structure.

In addition to any improvements in performance, the embodiments described herein may also be used for radiation safety of electronic devices. As described above, the embodiments described herein can reduce SAR by reflecting away from one side of the user device electromagnetic fields of electromagnetic energy radiated in response to the surface currents created on an antenna element of the antenna structure. This reduces the amount of radiation within any cubic volume on the one side of the user device. The beam-shaping elements or the magneto-dielectric material, or both, being disposed in strategic locations relative to the antenna element and a surface that is in close proximity to a human body party, can be used to reduce SAR values of one or more antennas of an electronic device. For example, a front cover of the mobile phone can be in close proximity to a user's head, thus, the WAN antennas of a mobile phone are placed at a bottom side of the mobile phone, since the top side is closer to the user's head. Using the embodiments of magneto-dielectric material and/or beam-shaping elements as described herein, the WAN antennas can be placed on the top side of the mobile device as the incident electromagnetic fields can be reflected away from the front cover of the mobile phone. The SAR values are measured within any given 1 g tissue area (e.g., ten by ten by ten millimeters (10×10×10 mm) volume within an antenna area. The embodiments described herein can be used to meet the SAR requirement where SAR is tested at 0 mm distance between the user device and the phantom. In particular, the antenna structure of FIG. 2A can result in a SAR value lower than 1.6 w/kg at 2.44 GHz with nominal RF power (e.g., 13 dBm or 0.02 Watts) in a slant position. The reduced SAR value can allow the antenna structure to operate a higher transmit power, resulting in better communication coverage. The higher transmit power and better communication coverage can result in a better user experience of the user device. For some SAR tests, the user device 200 needs to be tested at 0 mm distance between the user device 200 and a phantom and result in a SAR value lower than 1.6 w/kg at 2.44 GHz and 5.5 GHz with nominal RF power (e.g., 13 dBm or 0.02 Watts in a slant position). It should be noted that other countries have different SAR specifications. Also, SAR specifications might change over time. The embodiments of SAR reduction described herein can be applicable to those SAR specifications or changed SAR specifications as well.

Low SAR antennas, such as the antennas disposed on the antenna carriers described herein, are attractive options for tablet devices, wearable electronics, and any wireless consumer device. By reducing SAR values in the certain frequency bans, higher transmission power can be used. The higher transmission power increases throughput in the frequency band.

The magneto-dielectric materials may help to improve the bandwidth, such as in wide frequency bands. For example, dual-band WLAN frequency bands, such as dual-band Wi-Fi® bands, need to cover 2.4 GHz to 2.5 GHz and 5.2 GHz to 5.8 GHz. The embodiments described herein can be used to communicate in the dual-band WLAN frequency bands, such as the dual-band Wi-Fi® bands. The high-band (e.g., 5.2-5.8 GHz) is a wider bandwidth that usually needs to be covered by multiple resonant modes. The antenna structure can be used to provide one or more resonant modes in the high-band (e.g., 5.2-5.8 GHZ), as well as one or more resonant mode in the low-ban (e.g., 2.4-2.5 GHz). In particular, an antenna element in an antenna structure for multiple resonant modes can be configured with beam-shaping elements to radiate electromagnetic energy with lower SAR properties in a direction of one or more sides of the user device, such as a front cover.

The use of beam-shaping elements and/or magneto-dielectric material in a constrained antenna volume can also improve performance of an antenna as described herein. In a small volume, large frequency bandwidth for antennas can be achieved by having materials which have both high relative permittivity (dielectric property) and high relative permeability (magnetic property). But in conventional smartphone designs, dielectric-only materials such as plastics are used. These dielectric-only materials usually have relative permittivity of three and relative permeability of one. As described herein, the wave impedance is a ratio of relative permeability to relative permittivity. Because of low permeability and high permittivity, there will be a mismatch in wave impedance to free space. Hence frequency bandwidths for antennas are reduced in these conventional smartphone designs. As described herein, magnetic materials can be inserted into the plastic parts of the device. The low loss magnetic materials can be added at strategic locations to selectively improve the various antennas performance. This magnetic loading may improve the antenna frequency bandwidth for a given volume of the antenna, and the higher the permeability of the magnetic material, the greater the antenna improvement. The improved antenna performance may result in lesser power transmit, and hence less effort in dissipating power. The magnetic loading of dielectric material may provide more strength than ordinary plastic. In some cases, the magnetic material is added in top and bottom parts of the plastic caps. Some implementations of antenna carriers with magneto-dielectric materials are illustrated and described below with respect to FIGS. 4A-4C and implementations of antenna carriers with magneto-dielectric materials and beam-shaping elements are illustrated and described below with respect to FIGS. 5A-5D.

Figure 4A:
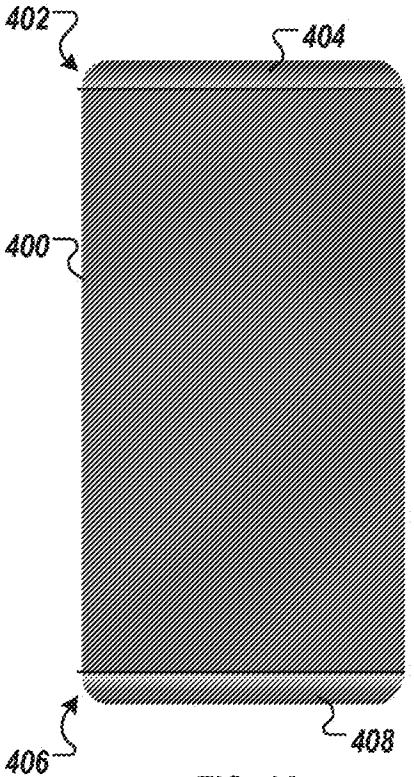
FIGS. 4A-4C are rear views of a user device with different configurations of magneto-dielectric materials of antenna carriers according to various embodiments.
Figure 4B:
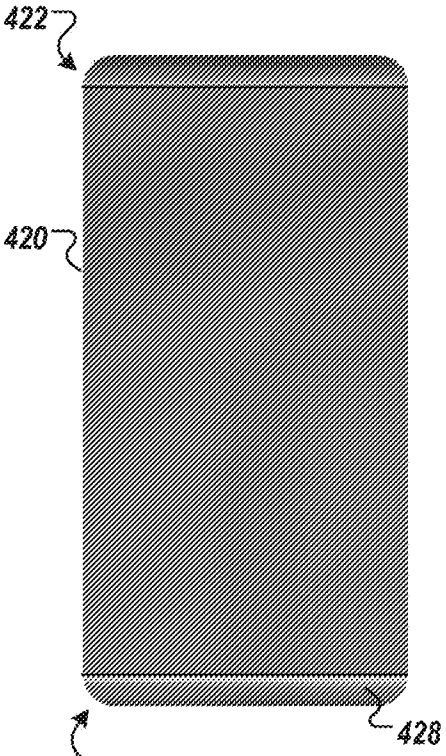
Figure 4C:
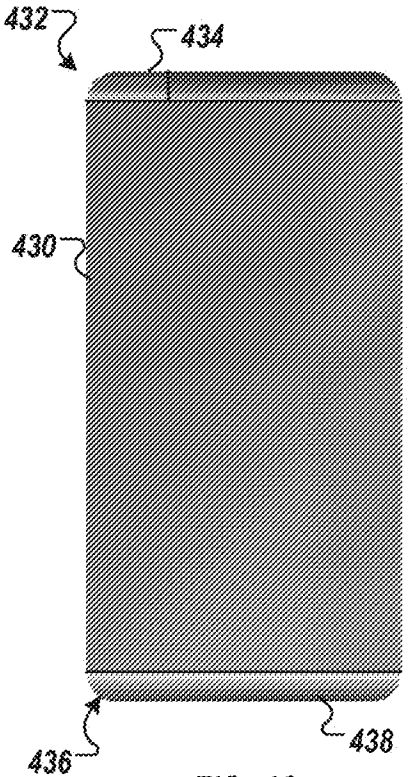

FIGS. 4A-4C are rear views of a user device with different configurations of magneto-dielectric materials of antenna carriers according to various embodiments.

FIG. 4A is a rear view illustrating magnetic materials 404, 408 added in both top plastic cap 402 and bottom plastic cap 406 of user device 400. FIG. 4B is a rear view illustrating magnetic material 428 added in only the bottom plastic cap 426 of user device 420. In this embodiment, no magnetic material is added in the top plastic cap 422 of user device 420. FIG. 4C is a rear view illustrating magnetic materials 434, 438 added in a top plastic cap 432 and a bottom plastic cap 436 of user device 430. In this embodiment, the magnetic material 438 is added in the bottom plastic cap 436 and magnetic material 434 is added to only a portion of the top plastic cap 432 or the top plastic cap 432 may be just a corner plastic cap. In another embodiment, the whole cap can be made of magneto-dielectric material and a portion of the bottom cap can be made of magneto-dielectric material.

It is very difficult to achieve good efficiency over large frequency bandwidth for antennas in a small volume. It is more so for the main WAN antennas that conventionally have been located on the bottom side of user devices. Magneto-dielectric materials, such as the magnetic material added to plastic caps as illustrated in FIG. 4A-4C, may be placed at the bottom side of user devices to improve efficiency of the main WAN antennas located at the bottom side. Also, more and more antennas are being placed on top sides of user devices. Magneto-dielectric material may be placed at the top side of user devices as well to improve efficiencies of those antennas as well.

The radiation safety of smartphones is extremely important. The specific absorption rates (SAR) of smartphones should be kept very low. For example, Cellular Telecommunications and Internet (CTIA) association requires all cell phones to comply with the Federal Communications Commission SAR limit of 1.6 W/Kg in 1 g of tissue. EU SAR: 2 W/Kg averaged over 10 gm of tissue. There may also be restrictions on transmitted power and placement of antennas in a device. Many a times the transmitted power has to be kept low in order to meet the SAR specifications. Hence the total radiation power (TRP) of the devices will be low resulting in not meeting Carrier (such as AT&T, Verizon, T-Mobile, etc.) specifications both in free space and Head/Hand. Also, as described above, most of the main antennas (which both transmit and receive RF power) are located on the bottom side of the device. One of the reasons for this is that the antennas which are located on the top of the device radiate power into the human head causing high SAR levels which are above the specifications. This often prevents best placement of antennas from the radiation efficiency point of view. Also, the human head can detune the antenna, which also reduces antenna efficiency.

In order to address these restrictions, the embodiments described below with respect to FIGS. 5A-5D utilize beam-shaping elements to reflect electromagnetic fields away from one or more surfaces of the user device. This effectively reduces SAR values at the surface of the user device. This may overcome the SAR restrictions, transmit power restriction, and antenna placement restrictions as described above. For example, the beam-shaping elements may permit the main WAN antennas to be located at the top side of the user devices, providing alternative placements of antennas. Also, the beam-shaping elements may increase the performance as described herein.

A beam-shaping element (also referred to as a beam-shaping geometry) may include a magneto-dielectric substrate (having both dielectric and magnetic properties) loaded with a set of metallic patches of arbitrary shapes. The set of metallic patches, in connection with magneto-dielectric material, act as almost a minor for the incident electromagnetic fields radiated from an antenna element. The set of metallic patches on the magneto-dielectric substrate may form a high-impedance surface with a reflection coefficient magnitude of one and phase zero degrees. In some cases, the high-impedance surface can be considered at perfect magnetic surface with a reflection coefficient magnitude of one. In addition to getting enhanced antenna performance, radiation towards human head may be reduced using the beam-shaping elements. Hence, specific absorption rates (SAR) could be kept very low. Also, loading effects caused by a human head on an antenna may be reduced, resulting in less de-tuning of the antenna. As the transmitting WAN antennas are mostly on bottom side, these beam shaping geometries may be used at the bottom side of the user device. In other cases, these beam-shaping elements could be used for the main WLAN antenna (e.g., the Wi-Fi® antenna) located at the top side of the user device. The beam-shaping elements may also be used to enable placing main WAN antennas at the top side of the user device as well. Various implementations of antenna carriers with magneto-dielectric materials and beam-shaping elements are illustrated and described below with respect to FIGS. 5A-5D.

FIGS. 5A-5D are rear views of a user device with different configurations of beam-shaping elements according to various embodiments.

Figures 5A, 5B, 5C, 5D:
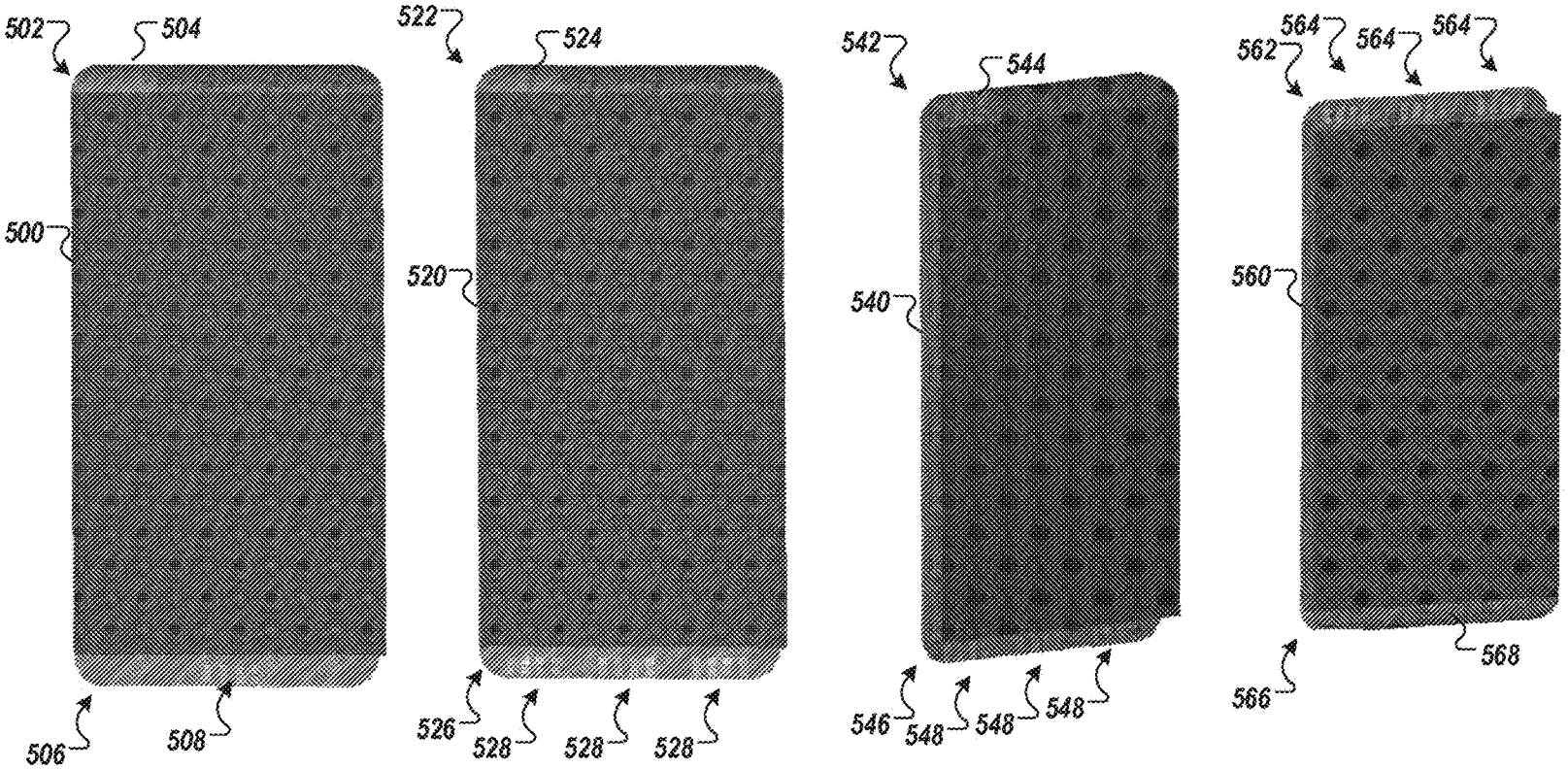
FIGS. 5A-5D are rear views of a user device with different configurations of beam-shaping elements according to various embodiments.

FIG. 5A is a rear view of a user device 500 with magneto-dielectric material 504 added in a top plastic cap 502 (corner cap) and a set of beam-shaping elements 508 added to a magneto-dielectric substrate in a bottom plastic cap 506. A magneto-dielectric substrate is disposed behind the set of beam-shaping elements (e.g., set of metal patches). On one side of the magneto-dielectric substrate a metal ground is disposed. The magneto-dielectric substrate with patches printed on one side and a metal ground printed on the other side may be placed behind a front display, such as at the top and bottom sides of the device.

FIG. 5B is a rear view of a user device 520 with magneto-dielectric material 524 added in a top plastic cap 522 (corner cap) and three sets of beam-shaping elements 528 added to a magneto-dielectric substrate in a bottom plastic cap 526.

FIG. 5C is a rear view of a user device 540 with a first set of beam-shaping elements 544 added to a first magneto-dielectric substrate in a top plastic cap 542 (corner cap) and three sets of beam-shaping elements 548 added to a second magneto-dielectric substrate in a bottom plastic cap 546.

FIG. 5D is a rear view of a user device 560 with three sets of beam-shaping elements 564 added to a magneto-dielectric substrate in a top plastic cap 562 and magneto-dielectric material 568 added in a bottom plastic cap 566.

Alternatively, other configurations of magneto-dielectric material and sets of beam-shaping elements may be used. Also, although these embodiments illustrate top and bottom plastic caps, in other embodiments, the magneto-dielectric material and set(s) of beam-shaping elements may be placed in other locations of the user device.

Figure 6:
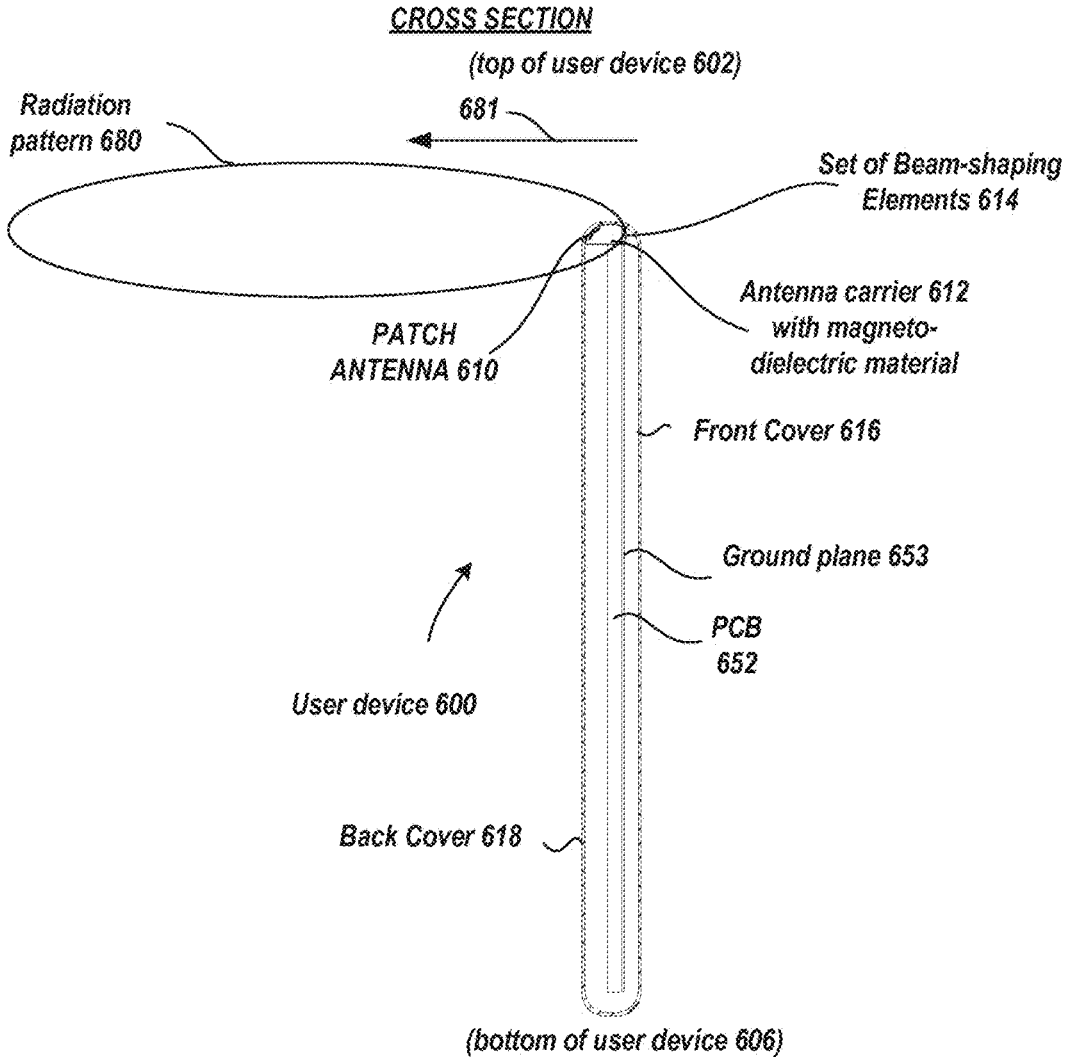
FIG. 6 is a cross-sectional side view of a user device with a patch antenna disposed on an antenna carrier with magneto-dielectric material and beam-shaping elements that reflects electromagnetic energy in a radiation pattern away from a front cover of the user device according to one embodiment.

FIG. 6 is a cross-sectional side view of a user device 600 with a patch antenna 610 disposed on an antenna carrier 612 with magneto-dielectric material and beam-shaping elements 614 that reflect electromagnetic energy in a radiation pattern 680 away from a front cover 616 of the user device 600 according to one embodiment. The user device 600 includes a PCB 652 with a ground plane 653 disposed on a side closer to the front cover 616 than a back cover 618. The patch antenna 610 is disposed at a top side 602 of the user device 600 and closer to the back cover 618 than the front cover 616. A set of beam-shaping elements 614 are disposed at one side of the antenna carrier 612 opposite to the side of the patch antenna 610. The set of beam-shaping elements 614 may be disposed on a magneto-dielectric substrate as described herein. The patch antenna 610 radiates electromagnetic energy and the set of beam-shaping elements 614 on the magneto-dielectric substrate reflect incident electromagnetic fields away from the magneto-dielectric substrate in a first direction 681, forming a radiation pattern 680 that is directional. In particular, the radiation pattern 680 is formed as radiating away from the front cover 616. As described herein, the set of beam-shaping elements 614 disposed on the magneto-dielectric substrate can form a high-impedance surface with a reflection coefficient magnitude of one and phase zero degrees that acts as a mirror to reflect the electromagnetic energy away from the set of beam-shaping elements 614 in the first direction 681. The set of beam-shaping elements 614 effectively increase the electromagnetic energy radiated by the patch antenna 610 towards the back cover 618 and decreases the electromagnetic energy radiated by the patch antenna 610 towards the front cover 616. A similar patch antenna disposed on dielectric-only material and without beam-shaping elements would create a radiation pattern in multiple directions, including in the direction towards the front cover 616 and potentially into a user's head. The set of beam-shaping elements 614 and magneto-dielectric material can be used to reduce SAR values at the front cover 616 by reflecting incident electromagnetic fields away from the front cover 616.

During operation of an electronic device, such as user device 600, a current is applied to a RF feed by a transceiver or other RF circuitry on the PCB 652 to transmit or receive RF signal in a frequency range using the patch antenna 610, which is coupled to the RF feed at a feeding point and coupled to the ground plane 653 at a grounding point. The current applied to the RF feed creates surface currents on the patch antenna 610. When the current is applied to the RF feed, electromagnetic energy is radiated from the surface of the patch antenna 610.

In a further embodiment, applying the current at RF feed causes the patch antenna 610 to radiate energy in a first resonant mode in a first frequency range, and a second antenna of the user device 600 (not illustrated) can radiate electromagnetic energy in a second resonant mode in a second frequency range. Alternatively, the patch antenna 610 can be configured to radiate electromagnetic energy in multiple resonant modes when the RF signals are applied to the RF feed. Various frequency ranges may be achieved. In response to the applied current, when applicable, the antenna radiates electromagnetic energy to communicate information to one or more other devices. Regardless of the antenna configuration, the magnetic field forms a radiation pattern, including radiation pattern 680 that radiates away from the front cover 616 (or any other surface of a user device).

Figure 7:
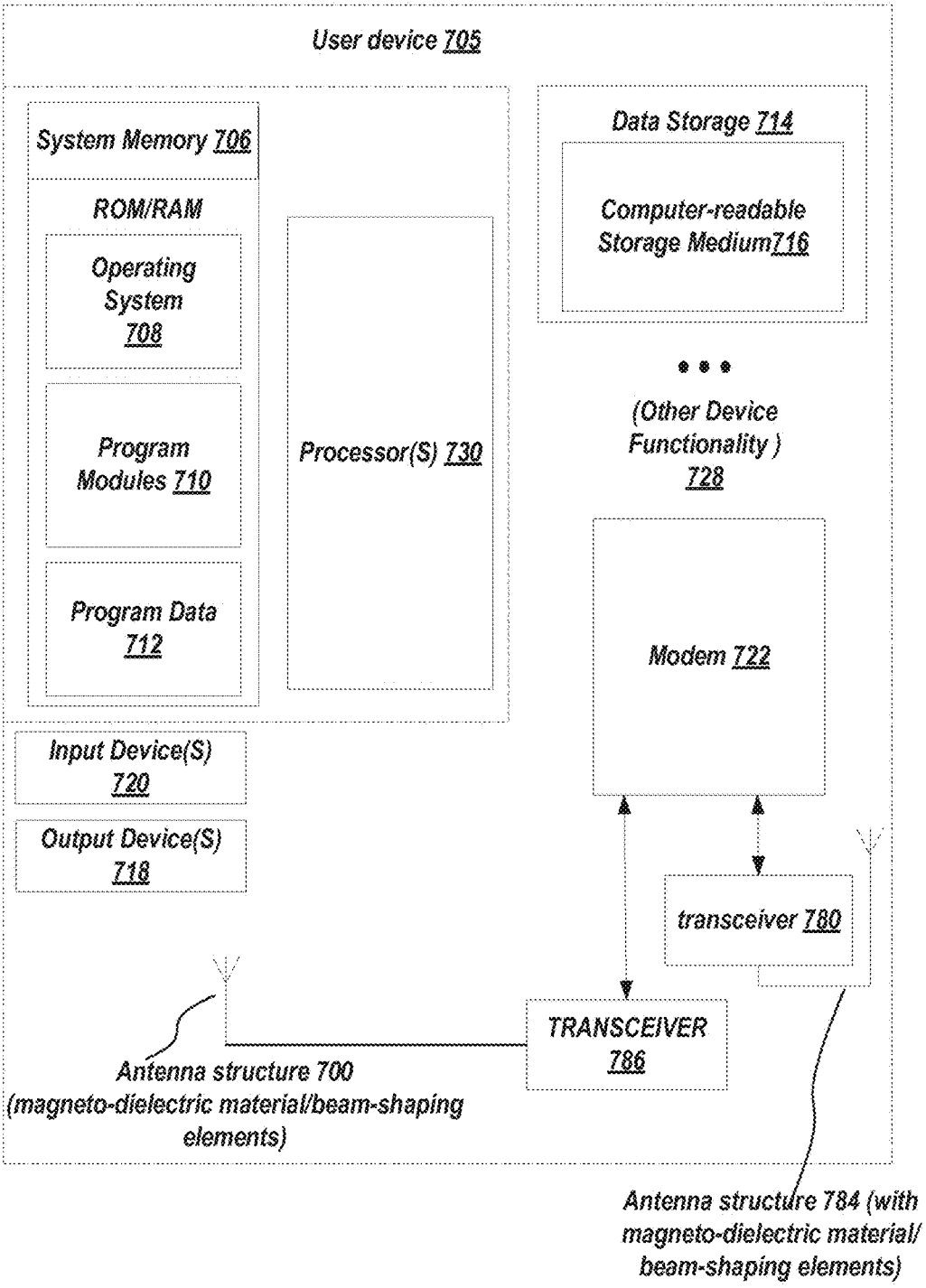
FIG. 7 is a block diagram of a user device in which embodiments of magneto-dielectric material, beam-shaping elements, or both may be implemented.

FIG. 7 is a block diagram of a user device 705 in which embodiments of magneto-dielectric material, beam-shaping elements, or both may be implemented. The user device 705 includes one or more processors 730, such as one or more CPUs, microcontrollers, field programmable gate arrays, or other types of processing devices. The user device 705 also includes system memory 706, which may correspond to any combination of volatile and/or non-volatile storage mechanisms. The system memory 706 stores information, which provides an operating system component 708, various program modules 710, program data 712, and/or other components. The user device 705 performs functions by using the processor(s) 730 to execute instructions provided by the system memory 706.

The user device 705 also includes a data storage device 714 that may be composed of one or more types of removable storage and/or one or more types of non-removable storage. The data storage device 714 includes a computer-readable storage medium 716 on which is stored one or more sets of instructions embodying any one or more of the functions of the user device 705, as described herein. As shown, instructions may reside, completely or at least partially, within the computer-readable storage medium 716, system memory 706 and/or within the processor(s) 730 during execution thereof by the user device 705, the system memory 706 and the processor(s) 730 also constituting computer-readable media. The user device 705 may also include one or more input devices 720 (keyboard, mouse device, specialized selection keys, etc.) and one or more output devices 718 (displays, printers, audio output mechanisms, etc.).

The user device 705 further includes a wireless modem 722 to allow the user device 705 to communicate via a wireless network (e.g., such as provided by a wireless communication system) with other computing devices, such as remote computers, an item providing system, and so forth. The wireless modem 722 allows the user device 705 to handle both voice and non-voice communications (such as communications for text messages, multimedia messages, media downloads, web browsing, etc.) with a wireless communication system. The wireless modem 722 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WLAN (e.g., Wi-Fi® network), etc. In other embodiments, the wireless modem 722 may communicate according to different communication types (e.g., WCDMA, GSM, LTE, CDMA, WiMAX, etc.) in different cellular networks. The cellular network architecture may include multiple cells, where each cell includes a base station configured to communicate with user devices within the cell. These cells may communicate with the user devices 705 using the same frequency, different frequencies, same communication type (e.g., WCDMA, GSM, LTE, CDMA, WiMAX, etc.), or different communication types. Each of the base stations may be connected to a private network, a public network, or both, such as the Internet, a local area network (LAN), a public switched telephone network (PSTN), or the like, to allow the user devices 705 to communicate with other devices, such as other user devices, server computing systems, telephone devices, or the like. In addition to wirelessly connecting to a wireless communication system, the user device 705 may also wirelessly connect with other user devices. For example, user device 705 may form a wireless ad hoc (peer-to-peer) network with another user device.

The wireless modem 722 may generate signals and send these signals to transceiver 786 for amplification, after which they are wirelessly transmitted via an antenna structure 700 with magneto-dielectric material, beam-shaping elements, or both, as described herein. Although FIG. 7 illustrates the transceiver 786, in other embodiments, a power amplifier (power amp) may be coupled to the antenna structure 700 to transmit and receive RF signal. Or, receivers may be used instead of transceivers, such as a GPS receiver. The antenna structure 700 may be any directional, omnidirectional or non-directional antenna in a different frequency band. In addition to sending data, the antenna structure 700 also can receive data, which is sent to wireless modem 722 and transferred to processor(s) 730. The user device 705 may include zero or more additional antennas (not illustrated) other than the antenna structure 700. For example, as illustrated in FIG. 7, the user device 705 includes a second antenna structure 784 with magneto-dielectric material, beam-shaping elements, or both as described herein. The second antenna structure 784 is coupled to the modem 722 via a transceiver 780 or a power amplifier as described above with respect to the antenna structure 700. The antenna structure 700 may be disposed in a top cap of the user device 705 and the second antenna structure 784 can be disposed in the top cap as well, or in a bottom cap of the user device 705 as described herein. When there are multiple antennas, the user device 705 may also transmit information using different wireless communication protocols. It should be noted that, in other embodiments, the user device 705 may include more or less components as illustrated in the block diagram of FIG. 7. In one embodiment, the antenna structure 700 is any of the antennas 107-119 of FIG. 1C and the second antenna structure 784 is any other one of the antennas 107-119 of FIG. 1C. In another embodiment, the antenna structure 700 is the antenna structure of FIGS. 2A-2B with magneto-dielectric material disposed between the antenna element 204 and ground plane 212. Alternatively, the antenna structure 700 may be other variants of antenna structures as described herein.

In one embodiment, the user device 705 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hot spot and a connection to a wireless carrier system. In one embodiment, the first wireless connection is associated with a first resonant mode of the antenna structure 700 that operates at a first frequency band and the second wireless connection is associated with a second resonant mode of the antenna structure 700 that operates at a second frequency band. In another embodiment, the first wireless connection is associated with the antenna structure 700 and the second wireless connection is associated with the second antenna structure 784. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a wireless modem 722 is shown to control transmission and reception via antenna structure 700, the user device 705 may alternatively include multiple wireless modems, each of which is configured to transmit/receive data via a different antenna and/or wireless transmission protocol.

The user device 705 delivers and/or receives items, upgrades, and/or other information via the network. For example, the user device 705 may download or receive items from an item providing system. The item providing system receives various requests, instructions and other data from the user device 705 via the network. The item providing system may include one or more machines (e.g., one or more server computer systems, routers, gateways, etc.) that have processing and storage capabilities to provide the above functionality. Communication between the item providing system and the user device 705 may be enabled via any communication infrastructure. One example of such an infrastructure includes a combination of a wide area network (WAN) and wireless infrastructure, which allows a user to use the user device 705 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hot spot connected with the network. The WLAN hot spots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 705.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public WAN, such as the Internet.

The user devices 705 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 705 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as: "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the term "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

a housing;

a printed circuit board (PCB) disposed within the housing, the printed circuit board comprising radio frequency (RF) circuitry;

a first cap disposed at a first side of the housing, the first cap comprising a first plastic material and a magneto-dielectric material, wherein the magneto-dielectric material has a relative permittivity value in a range of between two and nine for a dielectric property and a relative permeability value of greater than one for a magnetic property;

an antenna element disposed on or within a top surface of the first cap and electrically coupled to the RF circuitry, the antenna element to radiate electromagnetic energy in a resonant mode, wherein the relative permeability value increases a wave impedance of the antenna element, and wherein the wave impedance is a ratio of the relative permeability value to the relative permittivity value; and a set of parasitic metallic patches disposed on or within a bottom surface of the first cap, the set of metallic patches to reflect electromagnetic fields from the antenna element away from the set of parasitic metallic patches in a direction towards the antenna element.

2. The electronic device of claim 1, wherein the set of parasitic metallic patches disposed closer to a bottom surface of the first cap than the top surface of the first cap form a high-impedance surface with a reflection coefficient magnitude of one and phase approximately zero degrees, the high-impedance surface to reflect the electromagnetic fields away from the set of parasitic metallic patches in the direction towards the antenna element.

3. The electronic device of claim 2, further comprising:

a second antenna element; and a second cap comprising:

a second plastic material;

a second magneto-dielectric material having a second relative permittivity value in a range of between two and nine for a dielectric property and a relative permeability value of greater than one for a magnetic property; and a second set of parasitic metallic patches disposed closer to a first surface of the second magneto-dielectric material than a second surface to form a second high-impedance surface with a reflection coefficient magnitude of one and approximately phase zero degrees, the second high-impedance surface to reflect electromagnetic fields from the second antenna element away from the second set of parasitic metallic patches in a second direction.

4. The electronic device of claim 1, further comprising a ground plane disposed on the bottom surface of the first cap, the ground plane being electrically coupled to the PCB, wherein the first cap is a corner first cap, wherein the antenna element is a copper patch placed on the top surface of the magneto-dielectric material.

5. An apparatus comprising:

an antenna carrier disposed at a first side of a housing structure, wherein the antenna carrier comprises plastic material and magneto-dielectric material, the magneto-dielectric material having relative permittivity greater than two for a dielectric property and relative permeability greater than one for a magnetic property;

an antenna element disposed on a first surface of the antenna carrier, wherein the antenna element is configured to radiate electromagnetic energy, wherein the relative permeability of the antenna carrier increases a wave impedance of the antenna element relative to a wave impedance of the antenna element when disposed on the plastic material, wherein the wave impedance is a ratio of the relative permeability to the relative permittivity; and a set of parasitic metal elements disposed on a second surface of the antenna carrier, the set of parasitic metal elements to direct at least a portion of electromagnetic energy away from the second surface towards the first surface.

6. The apparatus of claim 5, wherein the set of parasitic metal elements causes the second surface to act as a magnetic surface having a reflection coefficient magnitude of one and phase approximately zero degrees, the second surface configured to direct the at least the portion of the electromagnetic energy away from the second surface.

7. The apparatus of claim 6, wherein the housing structure comprises a metal back, wherein the set of metal elements direct the at least the portion of the electromagnetic energy away from the set of metal elements in a direction towards the metal back.

8. The apparatus of claim 5, wherein the wave impedance of the antenna element increases efficiency of the antenna element relative to the antenna element when disposed on the plastic material.

9. The apparatus of claim 5, wherein the wave impedance of the antenna element increases frequency bandwidth of the antenna element relative to the antenna element when disposed on the plastic material.

10. The apparatus of claim 5, wherein the magneto-dielectric material of the antenna carrier comprises a composite material that includes a plastic material and a magnetic material.

11. The apparatus of claim 5, wherein the magneto-dielectric material of the antenna carrier comprises:

a magneto-dielectric substrate layer; and a plastic layer disposed on the magneto-dielectric substrate layer.

12. The apparatus of claim 11, wherein the set of parasitic metal elements is disposed on the magneto-dielectric substrate layer, and wherein the antenna element is disposed on the plastic layer.

13. The apparatus of claim 11, further comprising a metal layer disposed on a first surface of the magneto-dielectric substrate layer, and wherein the plastic layer is disposed on a second surface of the magneto-dielectric substrate layer.

14. The apparatus of claim 5, further comprising:

a second antenna carrier disposed at a second side of the housing structure, wherein the second antenna carrier comprises additional magneto-dielectric material; and a second antenna element disposed on a first surface of the second antenna carrier, wherein the second antenna element is configured to radiate electromagnetic energy in a second frequency band, wherein the magnetic property of the second antenna carrier increases at least one of efficiency of the second antenna element or frequency bandwidth of the second antenna element.

15. The apparatus of claim 5, further comprising a ground plane disposed on the second surface of the antenna carrier, wherein the antenna carrier is a plastic corner cap, wherein the antenna element is a copper patch placed on the first surface of the plastic corner cap and the ground plane is placed on the second surface of the plastic corner cap.

16. The apparatus of claim 15, wherein the relative permittivity relative permittivity is three for the dielectric property and the relative permeability is three.

17. A structure comprising:

an antenna carrier comprising:

a plastic material;

a magnetic material having relative permeability of greater than one;

a dielectric material having relative permittivity greater than two; and a layer of parasitic metal elements disposed on a first surface of the antenna carrier, the layer of parasitic metal elements to reflect incident electromagnetic fields of electromagnetic energy away from the layer of parasitic metal elements in a direction towards a second surface of the antenna carrier;

a ground plane disposed on the first surface of the antenna carrier; and an antenna element disposed on the second surface of the antenna carrier, wherein the relative permeability of the magnetic material increases a wave impedance of the antenna element relative to a wave impedance of the antenna element when disposed on the plastic material, wherein the wave impedance is a ratio of the relative permeability to the relative permittivity.

18. The structure of claim 17, wherein the antenna carrier is a cap disposed on a first side of a housing of an electronic device, wherein the cap comprises the plastic material, the magnetic material, the dielectric material, and the layer of parasitic metal elements.

19. The structure of claim 18, further comprising a layer of metal elements disposed closer to the first surface of the antenna carrier than the second surface of the antenna carrier, wherein the layer of metal elements reflect incident electromagnetic fields of the electromagnetic energy away from the layer of metal elements in a direction towards a metal back of the housing.

* * * * *